United States Patent [19]

Blickman

[11] 3,995,704

[45] Dec. 7, 1976

[54] BOARD GAME APPARATUS

[76] Inventor: Bernard Blickman, 115 Central Park West, New York, N.Y. 10023

[22] Filed: Nov. 6, 1975

[21] Appl. No.: 629,278

[52] U.S. Cl. ..... 273/131 B; 273/131 K; 273/136 D; 273/131 AB

[51] Int. Cl.[2] ..... A63F 3/00

[58] Field of Search ..... 273/130, 131, 134, 136

[56] References Cited

UNITED STATES PATENTS

| | | | |
|---|---|---|---|
| 998,233 | 7/1911 | Crocker | 273/131 E |
| 1,303,808 | 5/1919 | Landis et al. | 273/131 E |
| 3,633,913 | 1/1972 | Solimene | 273/132 |

FOREIGN PATENTS OR APPLICATIONS

| | | | |
|---|---|---|---|
| 8,824 | 5/1895 | United Kingdom | 273/131 K |
| 154,406 | 12/1920 | United Kingdom | 273/136 D |

*Primary Examiner*—Delbert B. Lowe
*Attorney, Agent, or Firm*—Mark T. Basseches; Paula T. Basseches

[57] ABSTRACT

The present invention relates to a game apparatus, and more particularly to a game apparatus of the board type, incorporating twenty five landing areas, arranged five by five. The landing areas are divided into two territories of ten landing areas each and a central neutral zone, the landing areas in the territories being assigned numerical values. Two sets of markers are provided having numerical values corresponding to the values of the landing areas in the territories.

In accordance with an embodiment, the game board defines a compact, foldable container or carrier which protects the playing surface and within which the markers may be stowed.

4 Claims, 6 Drawing Figures

BOARD GAME APPARATUS

BACKGROUND OF THE INVENTION

1. Field of the Invention

The present invention is in the field of games, and paritcularly board type games. More particularly, the present invention is in the field of board type games of a non-trivial nature, i.e., wherein the outcome cannot be predicted and wherein the outcome is dependent largely upon the skill of the player.

2. The Prior Art

Numerous board type games have been devised employing markers which are moved sequentially by the players. Perhaps the most familiar example of such a board type game is the game of checkers. Other board type games, by way of example, are disclosed in the below listed U.S. Pat. Nos.

3863,927 Moritz; 3633,913 Solimene; 3632,111 Wicks; 3624,808 Anderson; 3595,580 Bucko; 3588,114 Vogel; 2066,244 Bates; 1228,542 Durbin; 1211,748 O'Connor; 998,233 Crocker; 613,550 Ballou; 511,773 Higgins; Des. 98,232 Chi.

In certain games, such as checkers, the play involves a significant degreee of skill and virtually no element of chance is present, i.e., the skilled player will in virtually all instances defeat a less skilled player.

In other of the games, the element of chance predominates, such that the skill factor is essentially nullified.

SUMMARY OF THE INVENTION

The present invention is directed to an improved game device of the board type involving a mix or balance of chance factors and skill factors.

The invention employs a play board embodying the simplest matrix from which may be derived a non-trivial game, which I have discovered to be a matrix employing twenty five landing areas arrayed in a square pattern including five rows with five landing areas each.

A central row of the five landing areas is denomianated a neutral zone, the first and second, fourth and fifth rows being denominated territories.

The landing areas within the territories are assigned numerical values, the values being identical for each of the territories, there being preferably five different numerical values in each territory. Thus five of the 10 landing areas in each territory are assigned a different one of the five numerical values.

The game incorporates two sets of generally planar markers, the markers of each set having a common color different from the color of the markers of the other set.

The markers include a blank face and a face bearing a numerical value, the numerical values of the markers in a set corresponding to the numerical values of the landing areas in a territory.

The game is played randomly arranging the markers of each set on one of the territories referred to as home base. The players alternately move the markers in accordance with a sanctioned series of moves toward the opposite territory.

Numerous different methods of scoring may be employed.

In any case, the composite of the board matrix, numbering of the landing areas, numbering of the markers, and random orientation of the markers in the territories, lends to the creation of a game having an ideal mix of skill and chance, the outcome of which may not be predicted (non-trivial) and which nonetheless may be completed within a relatively short time as contrasted with other nontrivial games, such as chess by way of example.

The invention is further directed to a novel game board which functions also as a carrying case, the board including a raised perimetral border and a pair of fold lines corresponding with the separation between adjacent rows of landing areas, the perimeter and fold lines being so constructed and arranged that the board may be folded upon itself to define a space enclosing carrier within which the markers may be stowed.

Accordingly, it is an object of the invention to provide a non-trivial game device, the play of which incorporates elements of skill and chance.

A further object of the invention is the provision of a game device of the type described which is played on a simple five by five matrix, permitting the game to be completed in rapid fashion.

Still a further object of the invention is the provision of a game of the type described wherein the game board itself may be folded to form a container for the game pieces, the board embodying fold lines so positioned as not to intersect the landing areas of the play board and interfere with play.

To attain these objects and such further objects as may appear herein or be hereinafter pointed out, reference is made to the accompanying drawings, forming a part hereof, in which.

Figure 1:
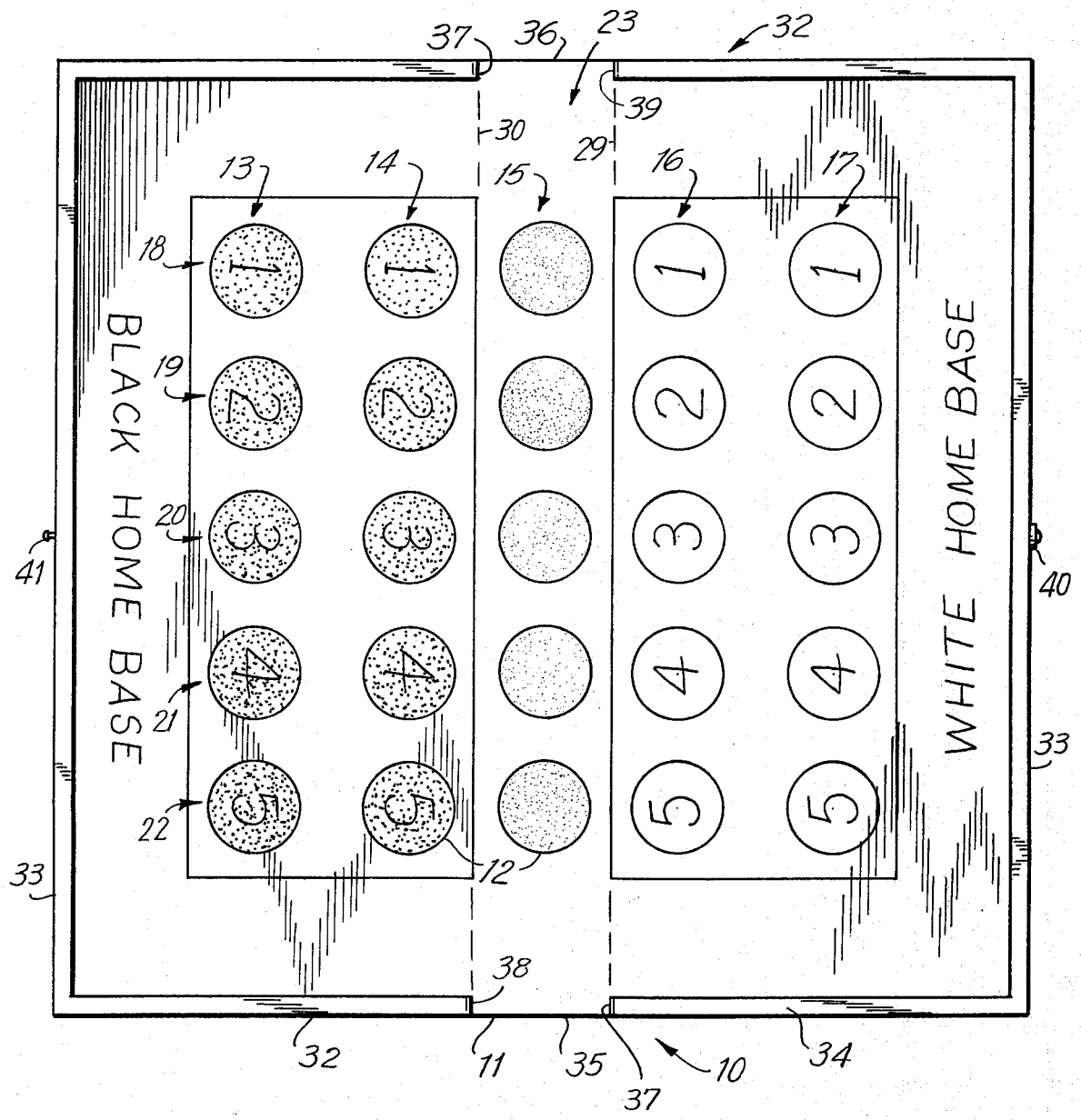
FIG. 1 is a plan view of a game board in accordance with the invention.
Figure 2:
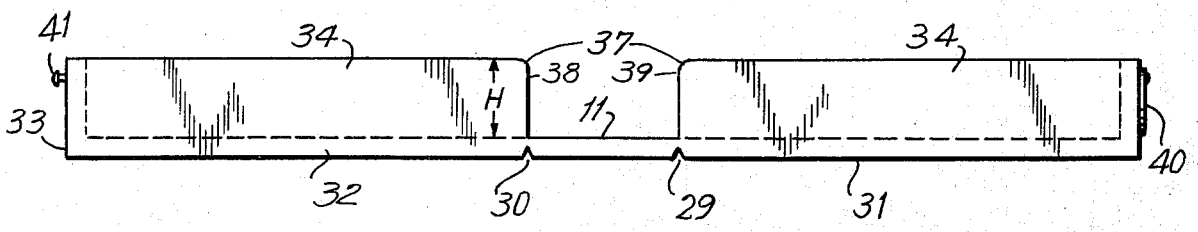
FIG. 2 is a side elevational view of the game board of FIG. 1.

Referring now to the drawings, in FIG. 1 there is shown a game board 10 in accordance with the invention, the board comprising a base portion 11, the front face of which is marked to define five landing areas, e.g., areas 12. The landing areas are aligned in five rows, namely, rows 13, 14, 15, 16 and 17, the landing areas in the various rows being arranged in aligned columns 18, 19, 20, 21 and 22. For convenience, the five landing areas 12 in the central row 15 will be referred to as the neutral zone 23, the landing areas in the rows 16 and 17 will be referred to as the white home base or territory, and the landing areas in the rows 13 and 14 will be referred to as the black home base or territory.

The game is played in conjunction with two sets of ten markers each. Five markers from each of a white set 24 and a black set 25 are illustrated in FIGS. 3 and 4, respectively, it being understood that the other five markers in each set are identical to the illustrated markers.

Each marker 26 is preferably disk shaped, including a planar upper surface 27 and a lower surface 28. The markers 26, which are opaque, bear on their upper surfaces a numerical indicium, e.g., for simplicity, one of the digits 1 through 5. It will thus be seen that each set of ten markers includes two markers bearing the numeral 1, two markers bearing the numeral 2, etc.

Figure 3:
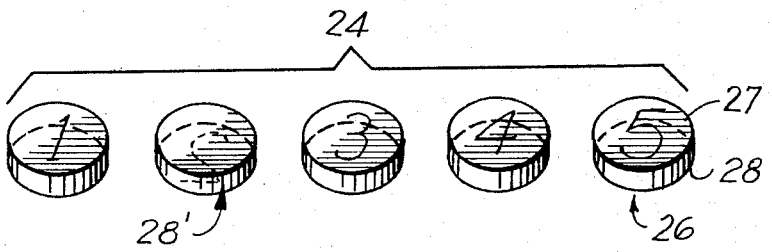
FIGS. 3 and 4 are perspective views of five markers from each of the sets of ten white and black markers, respectively.
Figure 4:
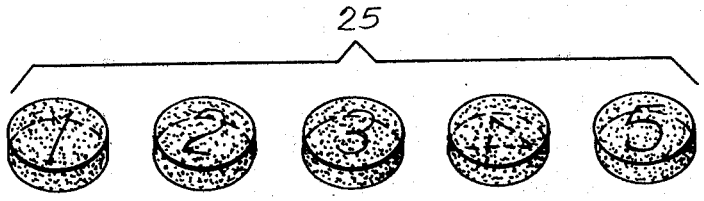

The under face 28 of the markers is blank, as may be seen from an inspection of the marker 28', FIG. 3.

The markers of the sets 24 and 25 are distinguished from each other preferably by means of color.

Returning to FIG. 1, the landing areas in the territories or home bases of the board bear numerical indicia corresponding with the numerical indicia of the markers. Thus, each home base includes two landing areas bearing numeral 1, two bearing numeral 2, etc.

Generally speaking, the game is played by arranging the markers of each set in random fashion on the landing areas of the corresponding home base or territory, in a manner hereinafter more specifically set forth. The players thereafter sequentially move the markers toward the opposite home base with the objective of advancing the maximum number of the markers, and particularly the maximum number of markers bearing the higher numerical values, into the territory or home base initially occupied by the markers of the opposite player.

Variations in the specific permitted moves and scoring principles may be made without departing from the spirit of the invention and, thus, the ensuing description should be understood to relate, in a non-limitative fashion, to one specific manner of play.

Similarly, numerous methods of scoring may be employed, points being assigned, for example, for one or all of the following: to the first player to advance all of his markers into the territory of an opponent; in accordance with the value of the numerals on the markers advanced into the opposing territory; in accordance with the values of the landing areas occupied or the product of marker value and landing area value, etc. Bonus points may be assigned a marker of a particular number being disposed on a comparably numbered landing area at the end of the game.

In accordance with a preferred form of play, each of the two players is assigned a complete set of ten markers which are placed numeral side down and shuffled, with only the blank faces visually accessible, so that neither player is aware of the numerical value of any specific marker. The randomly arranged markers are placed, still face down, over the landing areas in the home territory. The markers may then be inverted, whereby the player becomes aware of the value of each marker.

In accordance with a variation in the method of play, the markers are inverted so that their indicia bearing sides are exposed for a predetermined period of time to permit the participants to memorize the values and positions, and then the markers are reversed. Such modification, which requires the players to recall the values during the ensuing play, places a premium on concentration.

Alternative ways of effecting original placement of the markers may be employed, it being preferred, however, that an element of chance be involved in the placement so that the conditions will vary from game to game.

Manifestly, since scoring depends, in part at least, on the proximity in initial position of a marker to the comparably numbered marker on the territory toward which it is moved (by reason of the bonus hereinabove mentioned), initial positioning with a closer alignment of markers to comparably marked landing areas or high value markers to high value landing areas is likely to result in the scoring of a greater number of points.

After positioning of the markers and a determination by lot or otherwise of which player is to move first, the markers are advanced in accordance with a specified series of moves. The markers, in accordance with the preferred set of rules, may be moved forwardly, i.e., along the columns, or diagonally and forwardly, i.e., from one row to a forward row, landing on a position to the side.

Markers may not be moved onto an occupied landing.

Backward moves (either directly or diagonally) and jumping are permitted only when no other legal move is available to the player moving.

A game may be considered ended when on player has moved all of his markers into the home territory of his opponent. A game may also be considered ended even though neither player has advanced all his markers into the other's territory when no legal moves are available to either player.

As noted above, numerous methods of scoring may be employed. A bonus may be awarded the first player to move all of his markers into an opponent's territory. Similarly, if the game ends without a complete invasion of an opponent's territory, bonus points may be awarded to the last player able to make a legal move.

For purposes of scoring, markers on the neutral zone are ignored.

For each marker which, at the end of the game, is advanced into the territory of an opponent, a point score may be awarded. Preferably, the point score will correspond to the value of the marker.

Alternate means for scoring may include multiplying the value of the marker by the value of the landing area it occupies at the end of the game. In any case, it is preferred to put a premium on markers which have been advanced into landing areas bearing the identical value by doubling the point score, etc.

Numerous variations in the play rules and scoring may be made, and the invention is not to be considered as limited to any specific set of rules.

In accordance with the preferred method of play, a match will be considered won by the first player to win two games, the loser of a game being afforded the opportunity to move first in the succeeding game, the first mover in the initial game being determined by chance.

Referring again to the drawings, the game board lends itself to the formation of a convenient carrying case. For such purpose, a pair of hinge lines 29, 30 are formed in the board member 11, the hinge lines being defined, for example, by thinned areas cut into the bottom face 31 of the board. The hinge lines 29, 30 preferably define the limits of the neutral zone 23 and do not intersect any of the landing areas. Thus, when the board is opened for play, there will be no irregularities in the landing areas which might disturb positioning of the markers.

The side edges 32, 32 and the end edges 33, 33 of the board 11 have affixed thereto a perimeter strip 34, the strip running throughout all areas of the noted edges 32, 33 except the areas 35 and 36 defining the boundaries of the neutral zone. The height H of the perimeter strip 34 is half the width of the neutral zone 23. Preferably the corner portions 37 of the perimeter are slightly rounded.

Figure 5:
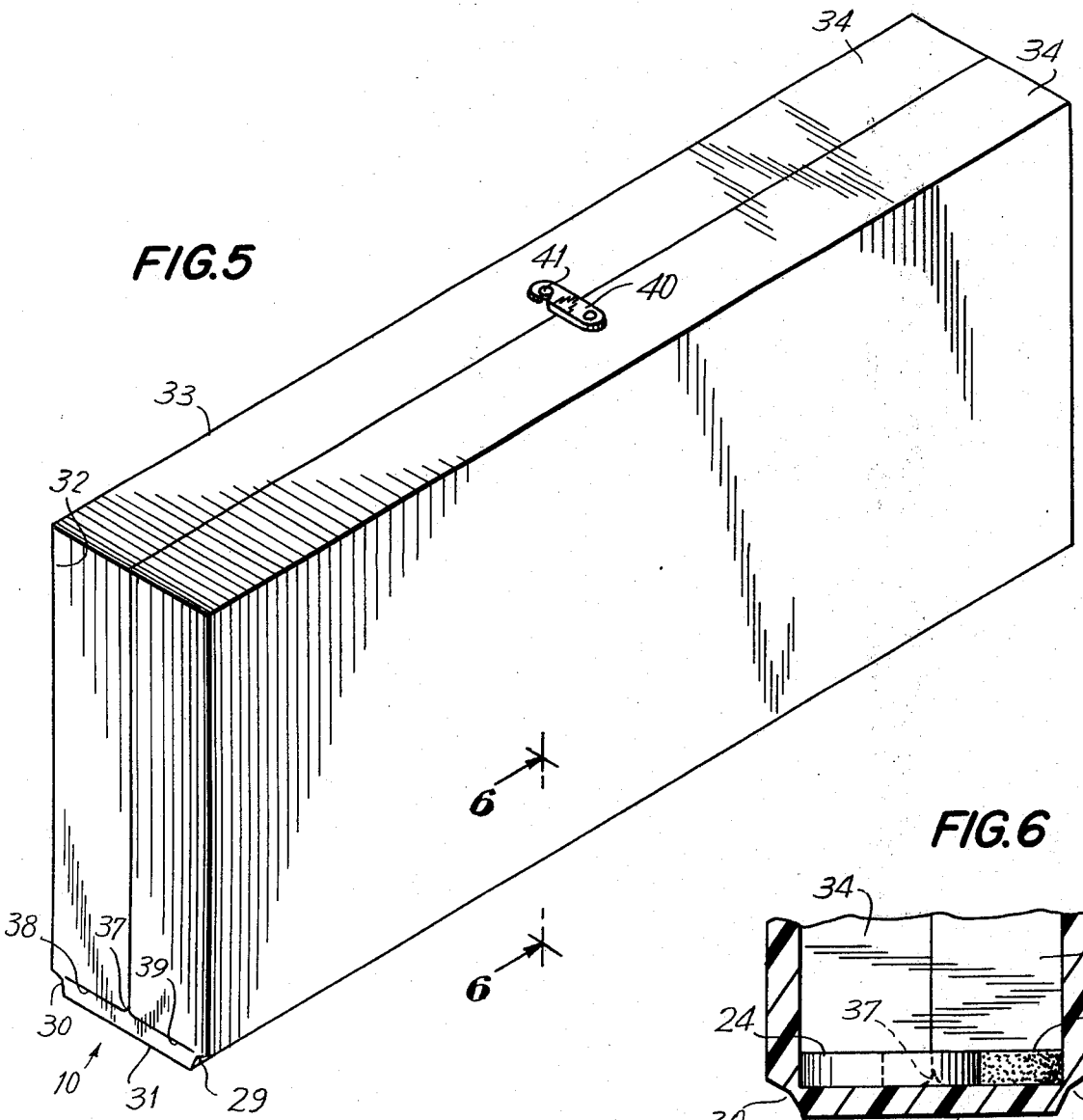
FIG. 5 is a perspective view of the game board in its case-forming configuration.
Figure 6:
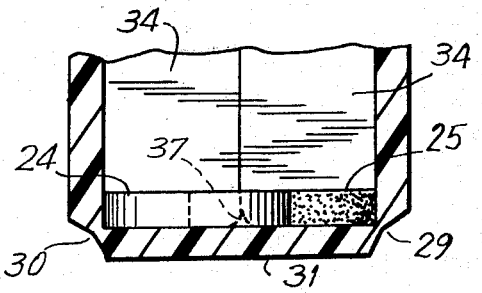
FIG. 6 is a fragmentary vertical section taken on the line 6—6 of FIG. 5.

As best apparent from an inspection of FIG. 5, the device is transformed from a game board to a container by folding the portions of the board to either side of the neutral zone upwardly through an angle of 90° to the position of FIG. 5. When thus located, the free or uppermost edge portions of the perimeter 34 engage each other and define a closure.

Similarly, the free edges 38, 39 of the perimeter strip engage, in the folded position, against the upper face of the board in the area of the neutral zone, forming a closure in such area, the rounded portions 37 providing clearance for pivotal movement of the board components.

In order to maintain the board halves in the closed position shown in FIG. 5, the device is provided with some form of catch or lock, such as a pivotal latch 40 adapted to hook about a receiver pin 41 fixed to the opposite board half.

From the foregoing it will be apparent that there is provided, in accordance with the invention, a game apparatus involving a relatively limited number of landing areas and markers, the play of which involves substantial elements of skill. By randomly locating the markers with respect to the home bases or territories, there is introduced into each game a variation from each other game.

By assigning to the markers and landing spaces numerical values and by employing a scoring system dependent upon an associative relationship between the numerical values of the markers and landing spaces, there is introduced into the game an element of analytical reasoning and strategy not present in other games, such as checkers. Value judgements must constantly be made, e.g., should emphasis be placed upon scoring by swift advance into the opponent's territory or by positioning high numbered markers on comparable squares.

While the game puts a premium, as does chess, on planning in advance, the game may, by reason of the selected board matrix, be completed in a relatively short period of time.

Numerous variations may suggest themselves to the skilled workers in the art and, accordingly, the invention is to be broadly construed within the scope of the appended claims.

Having thus described the invention and illustrated its use, what is claimed as new and is desired to be secured by Letters Patent is:

1. A game apparatus comprising a game board including an upper face having a substantially square play area having five transversely extending, longitudinally displaced rows, each said row incorporating five transversely spaced apart landing areas, said landing areas being also aligned in a longitudinal direction to define five longitudinally extending columns, the landing areas within each of the first, second, fourth and fifth rows bearing numerical indicia of values differing from each other, the values of the indicia being constant within each said column, the landing areas in said first and second rows defining a first territory and being of a first color differing from the color of the landing areas of said third row, and the landing areas of said fourth and fifth rows defining a second territory and being of a second color distinguishable from said first color and the color of said landing areas of said third row, the combination including first and second sets of ten markers each, said markers being opaque and having flat parallel upper and lower faces, said first and second sets being colored to correspond with said first and second colors, respectively, each of said markers having a blank face and a marked face, two markers of each said set bearing on their marked faces numerical indicia corresponding with the indicia in a different one of said columns.

2. Apparatus in accordance with claim 1 wherein said game board comprises a rigid planar member, generally rectangular in plan and including end edges parallel with said rows and side edges parallel with said columns, first and second linear hinge means formed in said board, said hinge means being parallel with said end edges and coinciding with the dividing line between said second and third rows, and said third and fourth rows, respectively, a perimeter strip extending upwardly from the side and end edges of said upper face of said board, said perimeter strip defining a border along the entirety of said end edges and extending from said end edges inwardly along said side edges, said perimeter strip terminating at butt portions perpendicular to said board and in registry with said hinge means, said perimeter strip including an upper edge portion parallel to and spaced from said upper surface of said board a distance substantially equal to one half the distance between said hinge lines, whereby, when each of said hinge members is folded upwardly through an angle of 90°, an enclosure is defined by the contacting upper edge portions of said perimeter strip and engagement of said butt portions of said perimeter strip with portions of said upper face of said board between said hinge members.

3. A game apparatus comprising a game board including an upper face having a substantially square play area including five transversely extending, longitudinally displaced rows, each said row being divided into five landing areas, said five landing areas being arranged in longitudinally extending columns, the longitudinal areas of the central said row comprising a zone, the landing areas within each of the first and second rows having numerical indicia of different values, the landing areas of said fourth and fifth rows having numerical indicia corresponding to the indicia of said first and second rows, the combination including first and second sets of ten markers each, said markers being opaque and having flat, parallel upper and lower faces, one said face of each marker being blank and the other said face being marked with a numerical indicium, the composite of indicia of the markers of each set corresponding with the composite of indicia of the numerical markings in said first and second rows, the markers of one said set including means rendering the same visually distinguishable from the markers of the other said set.

4. Apparatus in accordance with claim 3 wherein said game board comprises a rigid planar member, generally rectangular in plan and including end edges parallel with said rows and side edges parallel with said columns, first and second linear hinge means formed in said board, said hinge means being parallel with said end edges and coinciding with the dividing line between said second and third rows, and said third and fourth rows, respectively, a perimeter strip extending upwardly from the side and end edges of said upper face of said board, said perimeter strip defining a border along the entirety of said end edges and extending from said end edges inwardly along said side edges, said perimeter strip terminating at butt portions perpendicular to said board and in registry with said hinge means, said perimeter strip including an upper edge portion parallel to and spaced from said upper surface of said board a distance substantially equal to one half the distance between said hinge lines, whereby, when each of said hinge members is folded upwardly through an angle of 90°, an enclosure is defined by the contacting upper edge portions of said perimeter strip and engagement of said butt portions of said perimeter strip with portions of said upper face of said board between said hinge members.

* * * * *